US009216449B2

(12) United States Patent
Gatz et al.

(10) Patent No.: US 9,216,449 B2
(45) Date of Patent: Dec. 22, 2015

(54) CONTROLLED CRIMPING METHOD AND SYSTEM

(71) Applicant: Caterpillar Inc., Peoria, IL (US)

(72) Inventors: Michael Carl Gatz, Chillicothe, IL (US); Brett Edward Burke, Washburn, IL (US)

(73) Assignee: Caterpillar Inc., Peoria, IL (US)

( * ) Notice: Subject to any disclaimer, the term of this patent is extended or adjusted under 35 U.S.C. 154(b) by 315 days.

(21) Appl. No.: 13/692,822

(22) Filed: Dec. 3, 2012

(65) Prior Publication Data

US 2013/0160284 A1 Jun. 27, 2013

Related U.S. Application Data

(60) Provisional application No. 61/579,528, filed on Dec. 22, 2011.

(51) Int. Cl.
*B21D 39/00* (2006.01)
*B21D 39/04* (2006.01)

(52) U.S. Cl.
CPC ..... *B21D 39/00* (2013.01); *B21D 39/046* (2013.01); *B21D 39/048* (2013.01); *Y10T 29/53065* (2015.01)

(58) Field of Classification Search
CPC .... B21D 39/00; B21D 39/046; B21D 39/048; H01R 43/0484; H01R 43/048; Y10T 29/53065; Y10T 29/5367
See application file for complete search history.

(56) References Cited

U.S. PATENT DOCUMENTS

| | | | | |
|---|---|---|---|---|
| 3,196,647 | A * | 7/1965 | Schneider | 72/21.5 |
| 3,205,790 | A * | 9/1965 | Bollar | 72/19.9 |
| 4,400,967 | A | 8/1983 | Owens | |
| 4,742,470 | A | 5/1988 | Juengel | |
| 4,953,383 | A * | 9/1990 | Stiver et al. | 72/402 |
| 5,195,042 | A * | 3/1993 | Ferraro et al. | 700/117 |
| 5,337,589 | A * | 8/1994 | Gloe et al. | 72/9.5 |
| 5,799,383 | A * | 9/1998 | Baldwin et al. | 29/407.05 |
| 5,823,104 | A * | 10/1998 | Beisel et al. | 100/48 |
| 5,829,289 | A * | 11/1998 | Fisher et al. | 72/19.9 |

(Continued)

FOREIGN PATENT DOCUMENTS

| | | |
|---|---|---|
| CN | 1972768 | 5/2007 |
| CN | 101356323 | 1/2009 |

(Continued)

OTHER PUBLICATIONS

Sayavich, William E., "Global Asset Tagging & Identification System for Hydraulic Hose Assemblies," White Paper No. 101, Parker Hannifin Corporation, 2010, pp. 1-6.

*Primary Examiner* — Alexander P Taousakis

(57) ABSTRACT

A system for crimping a first component onto a second component includes a first portion and a second portion facing the first portion. The system also includes at least one actuator configured to move the first portion relative to the second portion to compress a die disposed between the first portion and the second portion. The compression of the die causes the first and second components located in the die to be crimped together. The system also includes a controller connected to the at least one actuator. The controller is configured to determine a value associated with an amount of deflection of the first portion while crimping and determine whether to stop the movement of the first portion based on the determined value.

16 Claims, 6 Drawing Sheets

(56) References Cited

U.S. PATENT DOCUMENTS

| | | | | |
|---|---|---|---|---|
| 2002/0056307 | A1* | 5/2002 | Ertl et al. | 72/402 |
| 2003/0173773 | A1 | 9/2003 | Udhoefer et al. | |
| 2007/0028660 | A1* | 2/2007 | Intagliata et al. | 72/402 |
| 2007/0129822 | A1* | 6/2007 | Nicholas | 700/32 |
| 2010/0326156 | A1* | 12/2010 | Hoskins et al. | 72/19.9 |
| 2011/0101680 | A1 | 5/2011 | Menor | |
| 2014/0283361 | A1* | 9/2014 | Van Essen | 29/516 |

FOREIGN PATENT DOCUMENTS

| | | |
|---|---|---|
| GB | 2197812 | 6/1988 |
| WO | 2010120373 | 10/2010 |

* cited by examiner

CONTROLLED CRIMPING METHOD AND SYSTEM

PRIORITY

This application claims the benefit of priority from U.S. Provisional Application No. 61/579,528, filed Dec. 22, 2011, which is herein incorporated by reference in its entirety.

TECHNICAL FIELD

The present disclosure relates generally to a crimping method and system, and more particularly, to a controlled crimping method and system.

BACKGROUND

Crimping machines, together with associated crimping dies and controllers, are used in applications where an evenly-distributed, circumferentially applied force is needed to reduce the diameter of a workpiece without radial distortion. For example, the workpiece may include a coupling or connector for crimping onto an end of a hydraulic hose or tube.

In order to provide an evenly distributed, circumferentially applied force, crimping machines conventionally employ crimping dies disposed around the workpiece and having a curved inside surface adjacent the workpiece that substantially matches the curvature of the workpiece. An actuator and other components may be provided to apply a pressing force to the die. The crimp may be controlled to assure that the pressing force of the actuator is applied evenly to the die. For example, components may be provided to translate the linear forces of the actuator into radially applied forces on the die, causing the die to move uniformly to reduce the diameter of the workpiece.

An example of a crimping machine is described in U.S. Pat. No. 4,953,383 (the '383 patent) issued to Stiver et, al. The '383 patent describes a crimping machine including a die assembly that moves radially inwardly to crimp a coupling onto an end of a hose.

Although the '383 patent describes a crimping machine, the crimping machine of the '383 patent may not be optimal. For example, the crimping machine of the '383 patent includes a ram that is driven downward to contact the die assembly. To complete the crimp, the ram is driven downward until a full stroke of a driving means is readied. However, this crimping machine may not provide a sufficiently precise crimp diameter. For example, the full stroke of the driving means may produce a crimp diameter that is smaller or larger than the desired crimp diameter.

In some conventional crimping machines, the operator may visually monitor the crimp diameter to determine if the desired crimp has been achieved. For example, the operator may stop the crimping operation periodically, and may use calipers or another external measuring device to measure the crimp diameter to determine if the desired crimp has been achieved. However, this method requires manual input from the operator, and therefore may lead to inconsistencies and defects due to operator error. For example, the crimp diameter may be too large or too small, there may be significant variations in crimp diameters from workpiece to workpiece, etc.

The disclosed system is directed to overcoming one or more of the problems set forth above.

SUMMARY

In one aspect, the present disclosure is directed to a system for crimping a first component onto a second component. The system includes a first portion and a second portion facing the first portion. The system also includes at least one actuator configured to move the first portion relative to the second portion to compress a die disposed between the first portion and the second portion. The compression of the die causes the first and second components located in the die to be crimped together. The system also includes a controller connected to the at least one actuator. The controller is configured to determine a value associated with an amount of deflection of the first portion while crimping and determine whether to stop the movement of the first portion based on the determined value.

In a further aspect, the present disclosure is directed to a system for crimping a first component onto a second component. The system includes a first plate, a second plate facing the first plate, and at least one actuator configured to move the first plate relative to the second plate to compress a die disposed between the first plate and the second plate. The compression of the die causes the first and second components located in the die to be crimped together. The system also includes a controller connected to the at least one actuator. The controller is configured to determine an amount of deflection of the first plate while crimping and determine a crimp dimension based on the determined amount of deflection.

In another aspect, the present disclosure is directed to a method for validating a combination of a coupling, a hose, and a die using a controller, before crimping the coupling onto the hose using the die to form a crimped assembly. The method includes reading first identification information provided on the coupling, second identification information provided on the hose, and third identification information provided on the die using at least one input device. The method also includes communicating the first identification information, the second identification information, and the third identification information from the at least one input device to a controller. The method further includes determining, using the controller, whether a combination of the coupling, the hose, and the die is valid by comparing a combination of the first identification information, the second identification information, and the third identification information to combinations stored in a memory associated with the controller.

DETAILED DESCRIPTION

Figure 1:
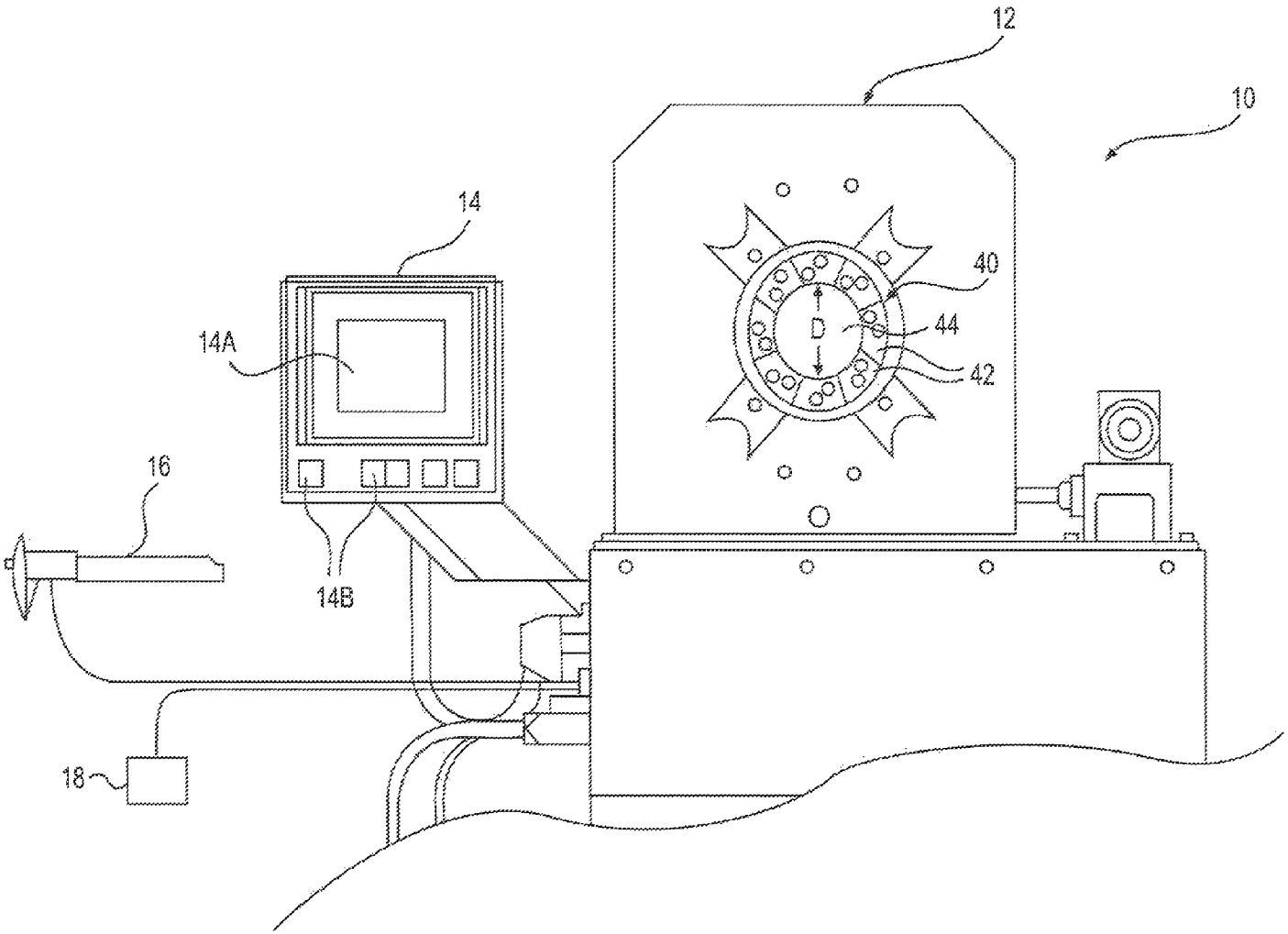
FIG. 1 is a front view of an exemplary disclosed crimping system including a crimping machine.
Figure 2:
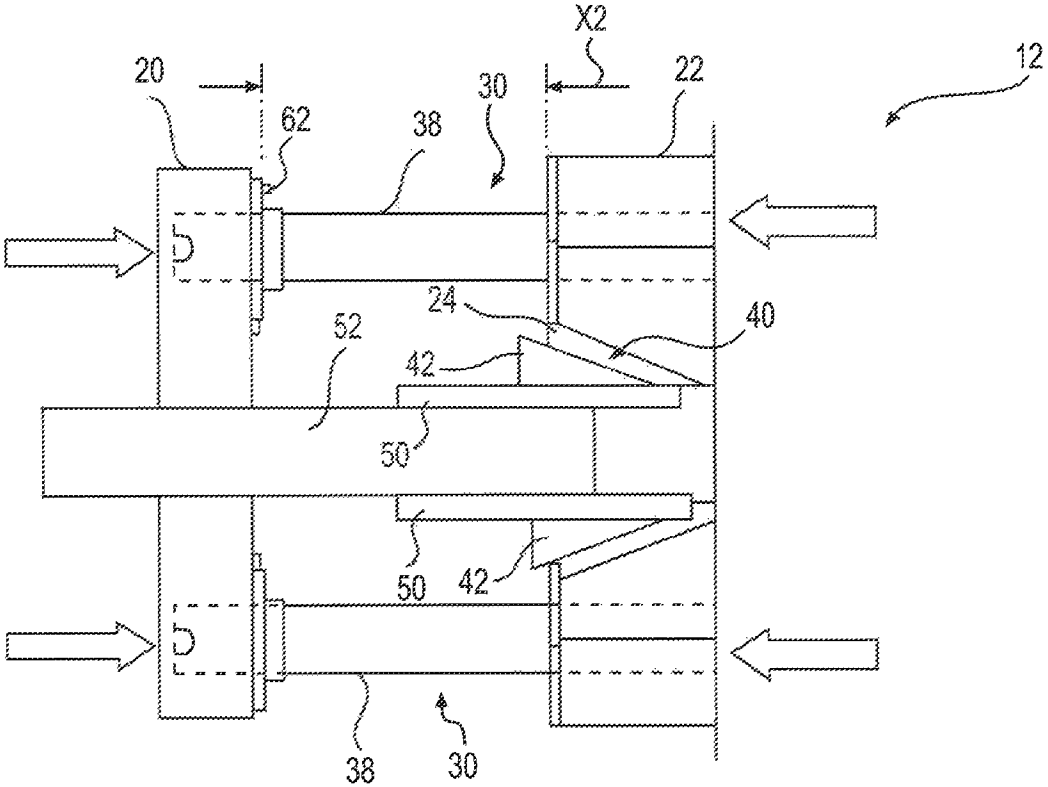
FIGS. 2 and 3 are cross-sectional views of the crimping machine of FIG. 1 during the crimping operation.

FIG. 1 illustrates an exemplary crimping system 10 having multiple components that cooperate to crimp two components together to form a crimped assembly. For example, the crimping system 10 may crimp a first component, such as a connector or coupling 50 (FIG. 2), onto an end of a second component, such as a hose 52 (FIG. 2). Alternatively, the crimping system 10 may crimp the coupling 50 onto an end of another type of elongated member, such as a cable, ferrule, or other hollow or solid elongated members, depending on the application. For example, for electrical connectors, the coupling 50 may be crimped onto an electrical or braided cable. For pneumatic and hydraulic applications, the coupling 50 may be crimped onto the hose 52, as described in the exemplary embodiment. The crimped components (e.g., the coupling 50 and/or the hose 52) may be made from various materials, depending on the application. In an exemplary embodiment, the coupling 50 may be formed from steel or other metal, and the hose 52 may be formed from elastomer and/or may be wire-reinforced.

As shown in FIG. 1, the crimping system 10 may include a crimping machine 12 as described below in detail in connection with FIGS. 2-5. The crimping machine 12 may be similar to the crimping machine disclosed in U.S. Pat. No. 5,799,383, entitled "Self Adjusting Hose Connector Crimping Apparatus and Method of Use," which is hereby incorporated by reference in its entirety.

The crimping system 10 may also include a controller 14 communicatively connected to the crimping machine 12. The controller 14 may embody a single microprocessor or multiple microprocessors that include components for controlling operations of the crimping machine 12 based on input from an operator of crimping machine 12 and based on sensed or other known operational parameters, as described in detail below. Numerous commercially available microprocessors can be configured to perform the functions of the controller 14. It should be appreciated that the controller 14 could readily be embodied in a general machine microprocessor capable of controlling numerous machine functions. The controller 14 may include a memory, a secondary storage device, a processor, and any other components for running an application. Various other circuits may be associated with the controller 14, such as power supply circuitry, signal conditioning circuitry, solenoid driver circuitry, and other types of circuitry. The controller 14 may also include a display 14A and one or more operator input devices 14B, such as buttons and other input devices. Optionally, the crimping system 10 may include a measurement device 16, such as a pair of calipers, to allow the operator to manually measure a dimension of the crimped components, if desired.

The crimping system 10 may also include one or more input devices 18, such as a sensor, scanner, or other device for detecting information, which may be communicatively connected to the controller 14. The input device 18 may communicate with the controller 14 via a wireless or wired communication link. For example, the input device 18 may be a radio frequency identification (RFID) reader, bar code reader, or data matrix reader that gathers information from a marking, such as an RFID tag, bar code, data matrix code, or other representation of information as described below.

Figure 3:
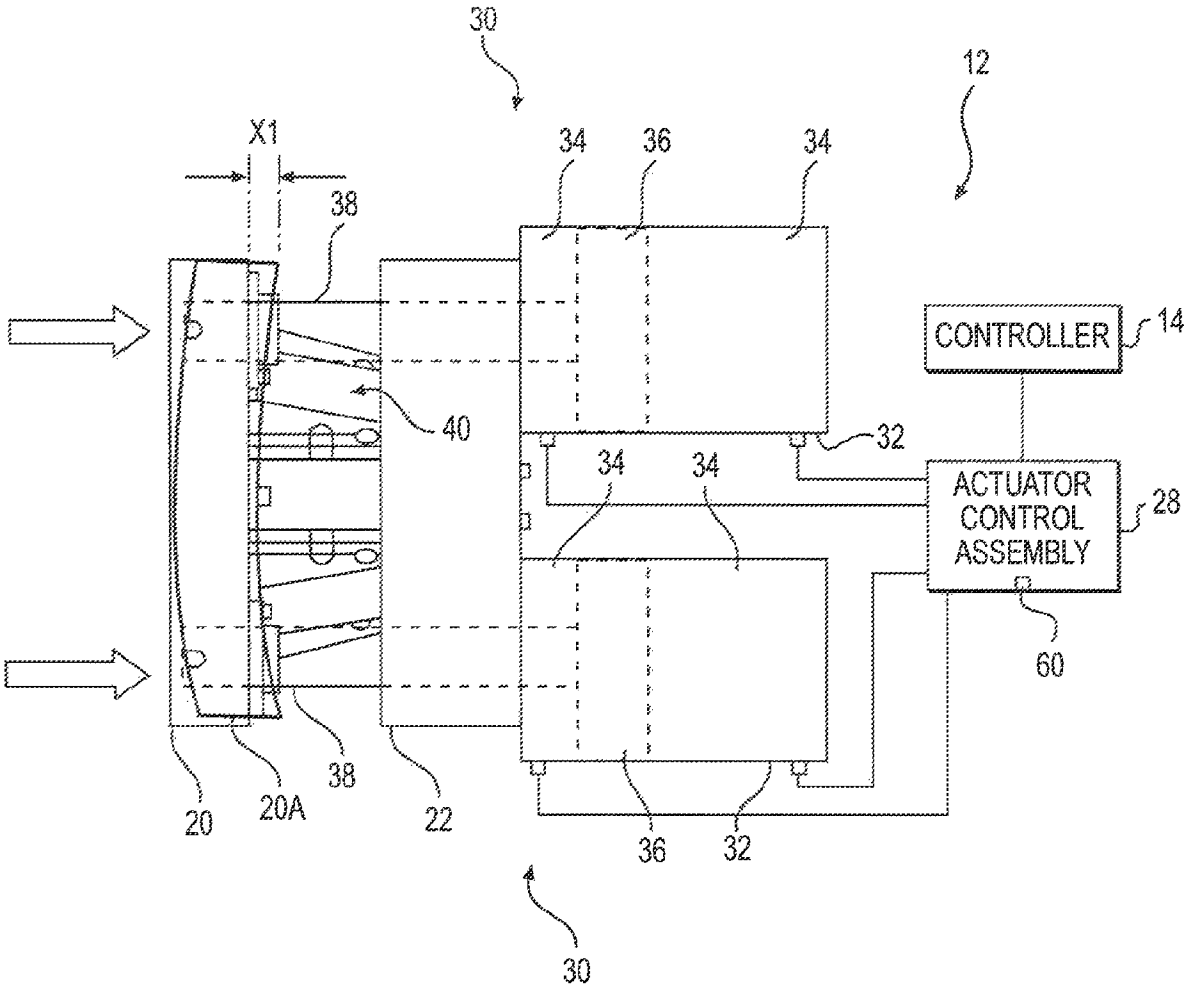

FIGS. 2 and 3 are schematic diagrams showing components of the crimping machine 12, according to an exemplary embodiment. The crimping machine 12 may include a first plate 20, a second plate 22, and at least one hydraulic ram, cylinder, or actuator 30 connecting the first and second plates 20, 22. Alternatively, the first and second plates 20, 22 may be portions formed in other shapes instead of plates. The first and second plates 20, 22 may be formed of metal or other rigid material. As shown in FIG. 2, the first plate 20 may include an opening through which the hose 52 may pass through when positioned between the two plates 20, 22.

The second plate 22 may form a conical-shaped die holder 24 that is integral to the second plate 22 or attached to the second plate 22. In the exemplary embodiment, the die holder 24 is integral to the second plate 22 and is formed as a tapered bowl in the second plate 22.

In the exemplary embodiment, four actuators 30 may connect the first and second plates 20, 22. Movement of the actuators 30 may cause the first plate 20 to move relative to the second plate 22. The crimping machine 12 may include an actuator control assembly 28 (FIG. 3) for communicating hydraulic fluid via a hydraulic circuit to and from the actuators 30. As shown in FIG. 3, each actuator 30 may include a housing 32 including a pair of actuating chambers 34 separated by a piston 36. The actuator control assembly 28 may include a hydraulic motor (not shown) and one or more control valves (not shown) for controlling flow between the motor and the respective actuating chambers 34.

As shown in FIG. 3, the housing 32 may be fixedly attached to the second plate 22. A guide rod 38 may connect the piston 36 to the first plate 20 so that the movement of the piston 36 corresponds to movement of the first plate 20 with respect to the second plate 22. Pressurized hydraulic fluid may be communicated to and from the actuating chambers 34 (e.g., by controlling the actuator control assembly 28) in order to control the movement (e.g., the direction and speed) of the pistons 36, thereby controlling the movement (e.g., direction and speed) of the first plate 20 relative to the second plate 22. The actuator control assembly 28 may be communicatively connected to the controller 14 so that the controller 14 may be configured to control the direction and speed of movement of the first plate 20 relative to the second plate 22. Alternatively, depending on the connections between the actuators 30, the first plate 20, and the second plate 22, movement of the actuators 30 may cause the first plate 20 and the second plate 22 to move towards or away from each other, or movement of the actuators 30 may cause the second plate 22 to move towards or away from the first plate 20.

Figure 4:
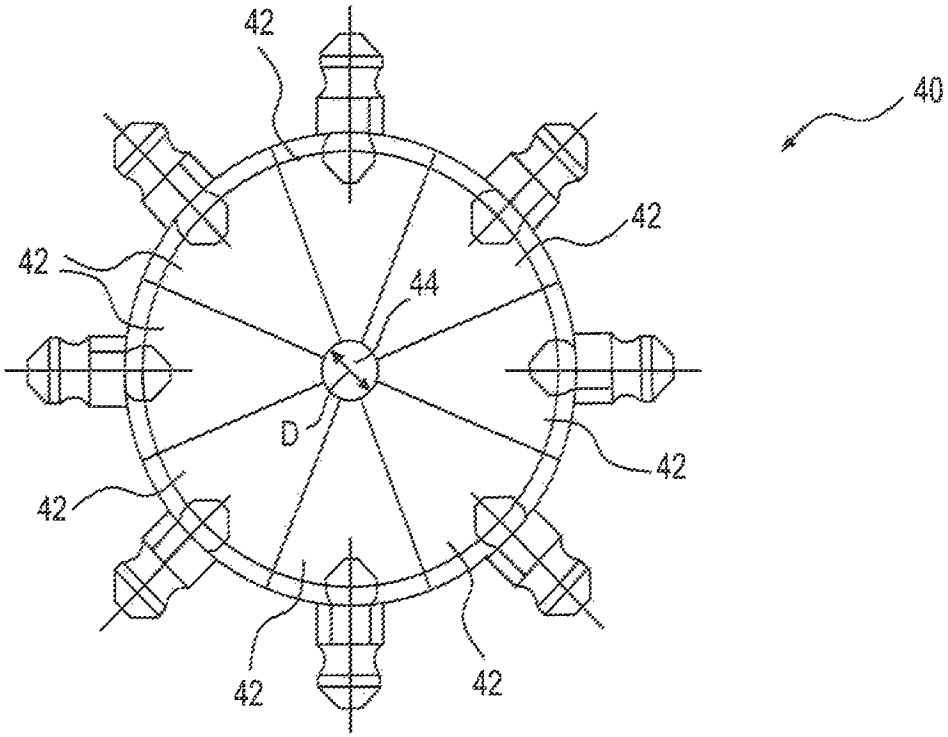
FIG. 4 is a front view of a die of the crimping machine of FIG. 1 in a compressed configuration.

As shown in FIGS. 2 and 3, a conical-shaped die 40 may be disposed in the die holder 24. FIG. 4 shows the die 40 according to an exemplary embodiment. The die 40 may be a radial die that is multi-segmented, e.g., formed in a plurality of radial segments or sections 42. For example, the die 40 may be formed from a ring having a tapered circumferential outer surface and that is cut into generally equal size die sections 42, e.g., 6 to 8 sections. The sections 42 may be connected together by a retainer (not shown), such as a rubber belt, placed around the circumferential outer surface or periphery of the die sections 42. FIG. 2 shows the cross-sections of two of the die sections 42, and FIG. 3 shows the tapered outer surface of the die sections 42. In the exemplary embodiment, the die 40 is divided into eight radial die sections 42. When disposed in the die holder 24, the tapered circumferential outer surface of the die sections 42 contacts the corresponding inner surface of the tapered bowl formed by the die holder 24. The outer surface of the die sections 42 may optionally include slots (not shown) configured to mate with protrusions (not shown) in the inner surface of the die holder 24 in order to guide the movement of the die sections 42 with respect to the die holder 24.

As shown in FIGS. 1 and 4, the inner surfaces of the die sections 42 form an opening 44 having a diameter D. The size of the inner diameter D varies for the die 40 depending on the location of the die sections 42 in relation to the die holder 24. FIG. 4 shows the die sections 42 in a compressed configuration when each die section 42 contacts the adjacent die sections 42 and the inner diameter D is at a minimum. The die sections 42 may move radially apart within the die holder 24 to form an uncompressed configuration in which there are spaces between the die sections 42. The inner diameter D in the uncompressed configuration is larger than the inner diameter D in the compressed configuration. Thus, the die 40 is capable of providing a set minimum inner diameter D. The die holder 24 may also be configured to receive other dies 40 so that the dies 40 may be replaceable. The dies 40 may vary based on, e.g., size of the minimum inner diameter D. The operator may select which of the dies 40 to use in the crimping machine 12 (e.g., having a particular minimum inner diameter D) in order to achieve a desired crimp, e.g., based on the size and material of the coupling 50, the hose 52, etc.

Before starting the crimping operation, the crimping system 10 may be used to identify the die 40, the coupling 50, and the hose 52 to verify that the combination is valid. For example, the operator may use the input device 18 to read information on the die 40, the coupling 50, and the hose 52, such as information in bar codes, RFID tags, data matrix codes, or other markings provided on (e.g., affixed, attached, or integral to) the respective die 40, coupling 50, and hose 52. In an embodiment, the input device 18 may be a single bar code, RFID, or data matrix code reader configured to read information from each of the die 40, the coupling 50, and the hose 52. The die holder 24 may also include such a reader or a sensor configured to read information from the die 40 automatically when the die 40 is received in the die holder 24.

The information stored on and read from the die 40, the coupling 50, and the hose 52 may include identification information, such as information indicating one or more of size, shape, material, manufacturer, model, type, characteristic, part number, or other information identifying the respective die 40, coupling 50, and hose 52. The identification information may also indicate information for components that may be used with the component bearing the identification information. For example, the identification information on the coupling 50 may indicate identification information for dies 40 that may be used to crimp the coupling 50 and/or for hoses 52 onto which the coupling 50 may be crimped.

The input device 18 may communicate the identification information to the controller 14, which may determine whether the combination of the die 40, the coupling 50, and the hose 52 is valid, e.g., so that the combination may form a desired crimp. For example, the controller 14 may include or may be connected to a database that stores information relating to combinations of dies 40, couplings 50, and hoses 52 that are valid. Thus, the controller 14 may determine whether the combination of the die 40, coupling 50, and hose 52 scanned by the operator is valid. Examples of invalid combinations may include combinations in which one of the components of the combination has the wrong size (e.g., too large, too small, etc.), is formed from an incompatible material (e.g., too hard, too soft, etc.), etc. Alternatively, or in addition, the valid combination(s) may be selected or specified by the operator. Thus, the controller 14 may compare the identification information received using the input device 18 (or other information determined from the identification information received, using the input device 18) to to the valid combinations to check that the combination of the die 40, coupling 50, and hose 52 scanned by the operator is a valid combination. After confirming that the combination is valid, the controller 14 may allow the crimping operation to start. If the combination is not valid, then the controller 14 may display a warning to the operator and/or may prevent the start of the crimping operation until one or more of the components (e.g., the die 40, coupling 50, and/or hose 52) is replaced and the combination is determined to be valid. The crimping system 10 (e.g., the display 14A) may inform the operator when the wrong component (e.g., the wrong die 40, coupling 50, or hose 52) is placed in the crimping machine 12, and/or may recommend a replacement for the wrong component to produce a valid combination.

Confirming the validity of the combination of the coupling 50, hose 52, and die 40 may help to ensure that the proper coupling 50, hose 52, and die 40 are used to form the crimped assembly. For example, this may prevent the operator from choosing too small a die 40, which may cause the crimping system 10 to move the plates 20, 22 together so much that the crimping machine 12 may be damaged, or from choosing too large a die 40, which may form a crimp having an undesired or deformed shape. Crimps having an undesired or deformed shape may cause leaks or may have poor retention capability, which may be dangerous, for example, when the crimped assembly is used under high hydraulic pressure.

In addition, the crimping system 10 may also be used to identify for the operator the components to retrieve, e.g., the die 40, the coupling 50, and/or the hose 52, to form a desired crimped assembly. In an embodiment, the operator may have a previously-assembled crimped assembly, e.g., a coupling already crimped onto a hose. The previously-assembled crimped assembly may have an RFID tag, bar code, data matrix code, or other representation of information provided on the crimped assembly, such as assembly information for the crimped assembly. The assembly information may include identification information (e.g., part number) for the crimped assembly. The operator may use the input device 18 to read the assembly information from the tag or code on the previously-assembled crimped assembly (e.g., on the coupling 50 or the hose 52 of the crimped assembly). The input device 18 may communicate the assembly information to the controller 14, which may determine, based on the assembly information, the identification information for the coupling 50 and the hose 52 forming the crimped assembly, and/or the identification information for the die 40 used to form the crimped assembly. For example, the controller 14 may include or may be connected to a database that stores the assembly information for a plurality of crimped assemblies and identification information for the coupling 50, the hose 52, and/or the die 40 associated with each of the plurality of crimped assemblies. Alternatively, instead of using a database to determine the identification information, the assembly information provided in the tag or code on the previously-assembled crimped assembly may include the identification information for the coupling 50 and the hose 52 forming the crimped assembly, and/or the identification information for the die 40 used to form the crimped assembly, and the input device 18 may communicate the identification information to the controller 14. The display 14A may display to the operator the identification information for the coupling 50, the hose 52, and/or the die 40 to allow the operator to retrieve the coupling 50, the hose 52, and/or the die 40. Thus, the crimping system 10 may allow the operator to duplicate a crimped assembly.

At the start of the crimping operation (e.g., after determining that the combination of the die 40, the coupling 50, and the hose 52 is valid), the first and second plates 20, 22 are positioned apart from each other, as shown in FIG. 2, the die sections 42 are in an uncompressed configuration in the die holder 24, and the operator may place the components to be crimped (e.g., the hose 52 inside the coupling 50) inside the opening 44 in the die 40. After the pistons 36 begin moving in the actuating chambers 34 to pull the first plate 20 towards the second plate 22, the first plate 20 contacts the die sections 42, as shown in FIG. 3. Alternatively, instead of the first plate 20 contacting the die sections 42 directly, a die fixture or other component (not shown) may be attached to the first plate 20 and may contact the die sections 42.

With the first plate 20 contacting the die sections 42, the actuators 30 continue to move the first and second plates 20, 22 closer together so that the die sections 42 are compressed between the first and second plates 20, 22. Since the contacting surfaces of the die sections 42 and of the die holder 24 in the second plate 22 are tapered, the force acting on the die sections 42 from the die holder 24 includes an axial component and a radial component. The axial component may act generally parallel to the direction of travel of the first plate 20 and generally parallel to an axis of the die sections 42 that runs through a center of the die 40 (e.g., generally the center of the opening 44 formed by the die sections 42). The radial component may act generally along the radial direction of the die 40. The radial component causes the die sections 42 to move and compress together, thereby decreasing the inner diameter D of the opening 44. As the inner diameter D of the opening 44 decreases, the inner surfaces of the die sections 42 apply a circumferential compressive force against the coupling 50 to crimp the coupling 50 onto the hose 52.

The controller 14 may control when to stop the crimping operation (e.g., when to cause the actuators 30 to stop pulling the first plate 20 toward the second plate 22). For example, the controller 14 may receive input from the operator to stop the crimping operation or may determine automatically whether to stop the crimping operation. The controller 14 may determine automatically whether to stop the crimping operation based on one or more operational characteristics of the crimping machine 12, such as an amount of force applied to the crimped components, an amount of pressure in the hydraulic circuit associated with the actuators 30 (e.g., a pressure in the actuating chamber(s) 34, in a fluid line supplying fluid to the actuating chamber(s) 34, etc.), and/or a determined deflection of the first plate 20 and/or the second plate 22, as described below.

As shown in FIG. 3, deflection may occur in the first plate 20 when the actuators 30 move the plates 20, 22 closer together as the first plate 20 contacts the die sections 42. The deflection may cause the first plate 20 to move toward a deflected position 20A (FIG. 3). In the deflected position 20A, portions of the first plate 20 (e.g., portions closer to the attachment of the first plate 20 to the actuators 30) may be pulled closer to the second plate 22 than other portions of the first plate 20 (e.g., portions closer to the center of the first plate 20 and away from the actuators 30). The deflection of the first plate 20 may indicate that at least a portion of the force supplied by the actuators 30 is bending the first plate 20 instead of crimping the coupling 50 onto the hose 52.

In the exemplary embodiment, the controller 14 may determine a deflection X1 (FIG. 3) of the first plate 20 in order to compensate for the deflection X1 when determining when to stop the crimping operation and/or when the desired crimp dimension has been achieved. The deflection X1 of the first plate 20 may be determined, e.g., near the edges of the first plate 20, near the attachment of the first plate 20 to the actuators 30, etc., as will be described below. For example, as shown in FIG. 3, the deflection X1 may be a distance between a first location on an inner surface of the first plate 20 towards an edge of the first plate 20 and a second location on the inner surface of the first plate 20 towards a center of the first plate 20 along a direction of movement of the first plate 20.

Alternatively, depending on the configuration of the crimping machine 12 (e.g., the shape of the plates 20, 22, the connection of the actuators 30 to the first and/or second plates 20, 22, etc.), deflection may occur in the second plate 22 or in both the first and second plates 20, 22. In such configurations, the controller 14 may determine the deflection in the relevant plate(s) using the same principles described herein.

Figure 5:
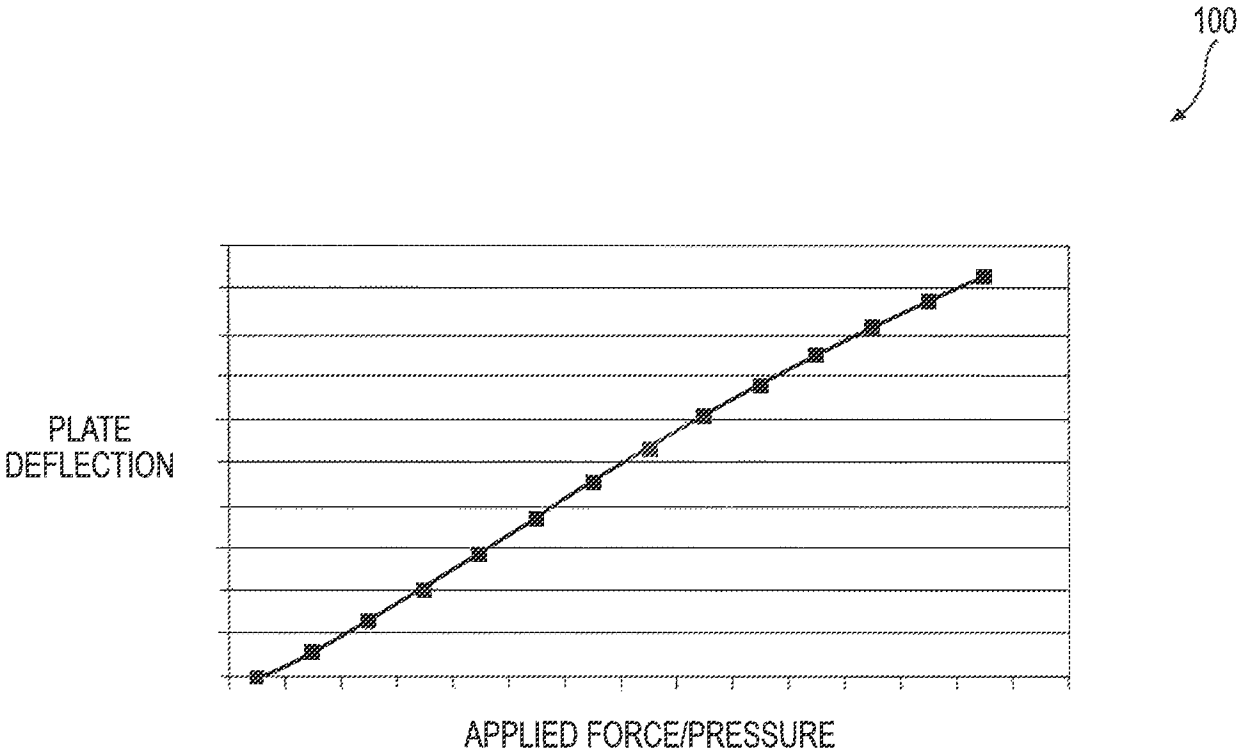
FIG. 5 is a graph showing plate deflection as a function of applied force or pressure.

In the exemplary embodiment, the controller 14 may store data, e.g., in the form of a compensation graph or curve 100 correlating the applied force or pressure to the deflection X1 of the first plate 20, as shown in FIG. 5, or other machine deformation. Alternatively, the data may be stored in the form of a table, equation, or other type of compilation of data. Using the stored compensation curve 100, the controller 14 may determine the deflection X1 of the first plate 20 based on the applied force or pressure.

The applied force or pressure may include the force applied to the crimped components or the amount of pressure in the hydraulic circuit including the actuators 30. For example, to determine the pressure in the hydraulic circuit, the crimping machine 12 may include a pressure sensing device 60 (FIG. 3). The pressure sensing device 60 may be configured to monitor a pressure in the hydraulic circuit associated with the actuators 30, such as a pressure in the actuating chamber(s) 34, a fluid line supplying fluid to the actuating chamber(s) 34, etc. The pressure sensing device 60 may be communicatively connected to the controller 14 to deliver a signal to the controller 14 representative of the sensed pressure. For example, in an embodiment, the sensed pressure may range from 0 to a pressure within the range of approximately 325 bar to approximately 400 bar.

The compensation curve 100 may be determined using a calibration process in which a solid rigid bar of material (not shown), e.g., a 30 millimeter diameter solid steel rod, is inserted into the opening 44 in the die 40 (instead of the coupling 50 and the hose 52). As shown in FIG. 2, the crimping machine 12 may include a distance sensing device 62 configured to deliver a signal to the controller 14 representative of the plate displacement, which is the distance X2 between the first and second plates 20, 22. During calibration, the pressure in the hydraulic circuit associated with the actuators 30 may be monitored using the pressure sensing device 60, and may be increased from 0 to a pressure within the range of approximately 325 bar to approximately 400 bar. As the pressure is increased, the first plate 20 is pulled towards the second plate 22 so that the die 40 applies a circumferential compressive force against the bar. Since the bar is made of solid steel or other rigid material, any change in the distance X2 between the two plates 20, 22, after the plates 20, 22 apply a force to the bar, is attributed to the deflection of the first plate 20 and is measured to obtain the compensation curve 100 of FIG. 5.

INDUSTRIAL APPLICABILITY

Figure 6:
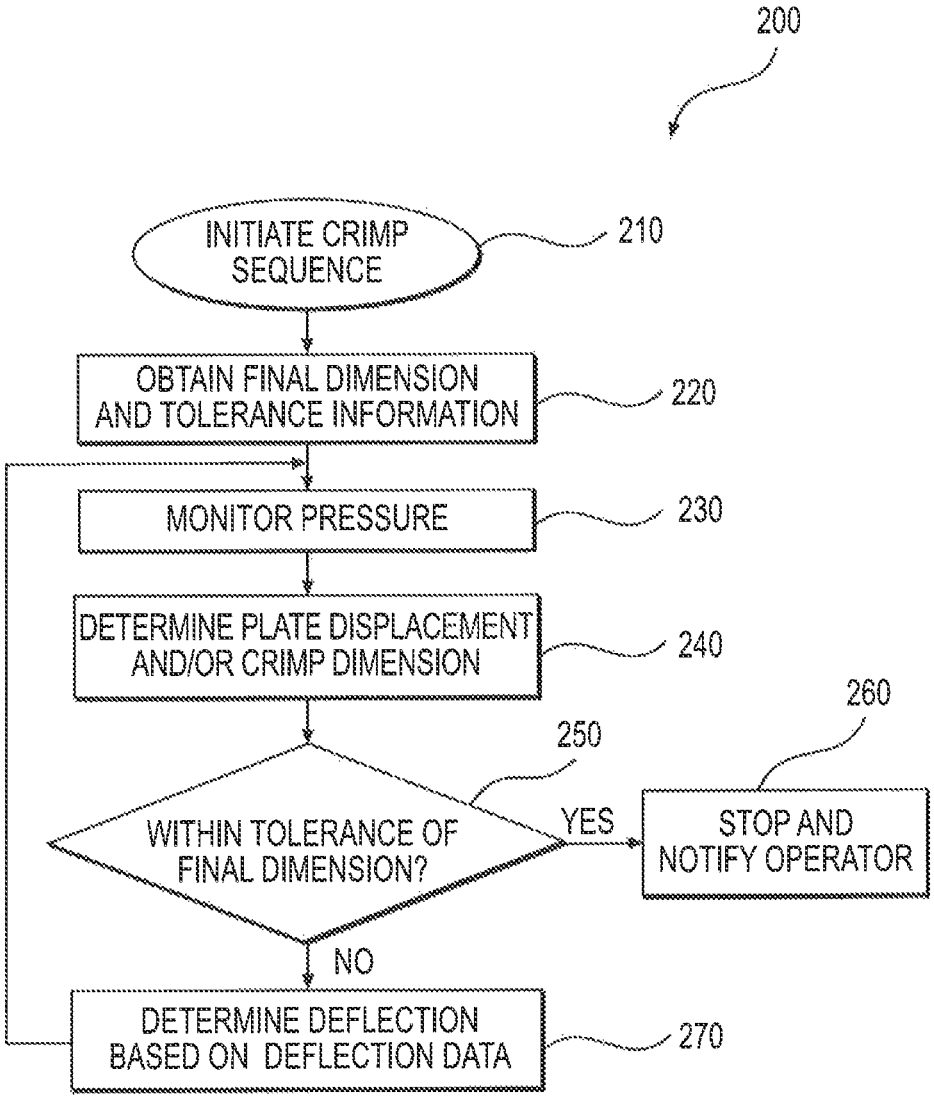
FIG. 6 is a flow chart illustrating an exemplary disclosed method of operating the crimping machine of FIG. 1.

The disclosed crimping system 10 may be applicable to any machine capable of performing the crimping operation. The disclosed crimping system 10 may more accurately control when to stop the crimping operation in order to obtain more exact and precise final crimp dimensions. The operation of the crimping system 10 using the method 200 shown in FIG. 6 will now be explained.

In step 210, the controller 14 may initiate the crimp sequence or operation. For example, the controller 14 may receive a command from the operator to initiate the crimp sequence.

In step 220, the controller 14 may obtain final dimension and tolerance information for the crimped components, e.g., the coupling 50 and the hose 52. For example, the final dimension may include a baseline final outer diameter of the coupling 50 when it is crimped onto the hose 52. The tolerance may include the allowable deviation from the determined baseline final outer diameter. The final dimension and tolerance information may be determined from a database (e.g., based on the specific coupling 50 and hose 52, which may be identified based on input from the operator), obtained from a remote entity (e.g., wirelessly), entered by the operator, etc. The controller 14 may then cause the actuators 30 to begin moving the pistons 36 in the actuating chambers 34 to pull the first plate 20 towards the second plate 22. Throughout the method 200, the actuators 30 may incrementally pull the first plate 20 towards the second plate 22, e.g., by incrementally increasing the pressure in the appropriate actuating chambers 34, until the controller 14 stops the crimping sequence as described below.

In step 230, the controller 14 may monitor the pressure in the hydraulic circuit. For example, as described above, the controller 14 may receive the monitored pressure from the pressure sensing device 60, and the pressure may include a pressure in the actuating chamber(s) 34, a fluid line supplying fluid to the actuating chamber(s) 34, etc.

In step 240, the controller 14 may determine the plate displacement X2 and/or the crimp dimension. In an embodiment, the controller 14 may receive the monitored plate displacement X2 from the distance sensing device 62. Based on the plate displacement X2, the controller 14 may determine the crimp dimension, i.e., the current dimension (e.g., outer diameter) of the crimped portion of the coupling 52. For example, the controller 14 may calculate the difference in crimp dimension (e.g., the difference between the original diameter and the current diameter) as approximately equal to half of the change in plate displacement X2. In another embodiment, the controller 14 may monitor the crimp dimension directly, e.g., using a measuring device (not shown).

In step 250, the controller 14 may determine whether the crimp dimension determined in step 240 is within the tolerance of the final dimension determined in step 220. If the determined crimp dimension is within the acceptable tolerance of the final dimension (step 250; yes), then in step 260, the controller 14 may stop the crimping sequence (e.g., by stopping movement of the actuators 30) and may notify the operator of the completion of the crimping sequence.

If the determined crimp dimension is not within the acceptable tolerance of the final dimension (step 250; no), then in step 270, the controller 14 may determine the deflection X1 of the first plate 20 based on the monitored pressure determined in step 230 and the stored deflection data, e.g., the compensation curve 100 shown in FIG. 5.

The method 200 then proceeds back to step 230. In step 230, the controller 14 monitors the pressure in the hydraulic circuit. Then, in step 240, the controller 14 determines the plate displacement X2 and/or the current crimp dimension as described above. However, in this step, the controller 14 also compensates for the deflection X1 determined in step 270 when determining the plate displacement X2 and/or the current crimp dimension. For example, the controller 14 may receive the monitored plate displacement X2 from the distance sensing device 62 and may adjust the monitored plate displacement X2 based on the deflection X1 determined in step 270, e.g., by adding the deflection X1 and the plate displacement X2. Based on this adjusted value, the controller 14 may determine the current crimp dimension. Then, in step 250, the controller 14 may determine whether the adjusted crimp dimension determined in step 240 is within the tolerance of the final dimension determined in step 220. If yes (step 250; yes), then in step 260, the controller 14 may stop the crimping sequence and notify the operator of the completion of the crimping sequence. If not (step 250; no), then steps 270, 230, 240, and 250 are repeated again as described above.

Therefore, in the crimping method 200, after the crimp sequence has been initiated (step 210) and the final dimension and tolerance information has been obtained (step 220), steps 230, 240, 250, and 270 are repeated periodically and continuously until the crimp dimension is determined to be within the acceptable tolerance of the final desired dimension (step 250; yes). For example, steps 230, 240, 250, and 270 may be repeated at set time intervals, e.g., 10 milliseconds or less.

Several advantages over the prior art may be associated with the crimping system 10. For example, the crimping system 10 may produce higher quality crimps that are more reliable. The crimps may be more precise and may be formed more uniformly using the automated process.

As noted above, the controller 14 may determine the deflection X1 of the first plate 20 in order to more accurately determine the crimp dimension. Measuring plate deflection helps to reduce variability in making crimps. This is due to the fact that each coupling 50 and hose 52 may require different pressures which leads to different deflections of the plates 20, 22. Without determining this deflection X1, the controller 14 may miscalculate the crimp dimension, and may then stop the crimp sequence too soon or too late. Thus, in the exemplary embodiment, errors in forming the proper dimension of the crimp may be reduced since the crimping system 10 may account for and compensate for nonlinearity in forming the crimps due to plate deflection or other machine deformation. This may improve the ability to provide more accurate crimps and more secure connections that are less likely to leak or fail. Providing more accurate crimps may reduce costs relating to having to redo or replace the crimped components. The crimping system 10 may also provide a safer work environment and increased operator confidence, particularly when the crimped components include hoses that are used in systems under high pressure and that transfer hot oils.

The crimping system 10 also provides more reliable crimps without requiring the operator to manually check the crimp dimensions, e.g., using the measurement device 16. The operator does not have to periodically check the crimp dimensions to ensure a more precise crimp. Thus, this automated process may reduce operator error.

It will be apparent to those skilled in the art that various modifications and variations can be made to the crimping system. Other embodiments will be apparent to those skilled in the art from consideration of the specification and practice of the disclosed crimping system. It is intended that the specification and examples be considered as exemplary only, with a true scope being indicated by the following claims and their equivalents.

What is claimed is:

1. A system for crimping a first component onto a second component, the system comprising:

a first portion;

a second portion facing the first portion;

at least one actuator configured to move the first portion relative to the second portion to compress a die disposed between the first portion and the second portion, the compression of the die causing the first and second components located in the die to be crimped together; and a controller connected to the at least one actuator and configured to:

directly measure an amount of deflection of the first portion while crimping, and determine whether to stop the movement of the first portion by calculating a crimp dimension based on the measured amount and determining whether a difference between the calculated crimp dimension and a desired crimp dimension is below a tolerance.

2. The system of claim 1, wherein the amount of deflection is a distance between a first location on an inner surface of the first portion towards an edge of the first portion and a second location on the inner surface of the first portion towards a center of the first portion along a direction of movement of the first portion.

3. The system of claim 1, further comprising:

a measuring device configured to monitor a pressure or force associated with the at least one actuator;

wherein the controller is communicatively connected to the measuring device and further configured to measure the amount of deflection of the first portion based on the measured pressure or force.

4. The system of claim 3, wherein the controller is configured to measure the amount of deflection of the first portion further based on stored data correlating the pressure or force and the amount of deflection.

5. The system of claim 4, wherein the controller is configured to measure the amount of deflection of the first portion further based on a graph or equation determined based on the stored data.

6. The system of claim 1, wherein the at least one actuator includes at least one hydraulic cylinder, the at least one hydraulic cylinder including a piston connected to the first portion to affect movement of the first portion.

7. The system of claim 6, further comprising:

a pressure measuring device configured to monitor a pressure of a hydraulic fluid supplied to the at least one hydraulic cylinder while crimping;

wherein the controller is communicatively connected to the pressure measuring device and further configured to measure the amount of deflection of the first portion based on the measured pressure.

8. The system of claim 1, further comprising:

a distance measuring device configured to monitor a distance between the first and second portions;

wherein the controller is communicatively connected to the distance measuring device and is further configured to calculate the crimp dimension based on the monitored distance.

9. The system of claim 1, wherein the controller is configured to periodically determine the amount of deflection and periodically determine whether to stop the movement of the second portion based on the amount of deflection.

10. The system of claim 1, wherein the first and second portions are plates, the first component is a coupling, and the second component is a hose.

11. The system of claim 1, further comprising:

at least one input device configured to read first identification information provided on the first component, second identification information provided on the second component, and third identification information provided on the die;

wherein the controller is configured to:

receive the first identification information, the second identification information, and the third identification information from the at least one input device, and determine whether a combination of the first component, the second component, and the die is valid based on the first identification information, the second identification information, and the third identification information.

12. The system of claim 11, wherein the controller is further configured to compare a combination of the first identification information, the second identification information, and the third identification information to stored combinations to determine whether the combination of the first component, the second component, and the die is valid.

13. The system of claim 11, wherein:

the first identification information, the second identification information, and the third identification information are provided in bar codes, RFID tags, or data matrix codes; and the at least one input device includes a bar code, RFID, or data matrix code reader.

14. The system of claim 1, wherein the first component and the second component form a crimped assembly, and the system further includes:

at least one input device communicatively connected to the controller, the at least one input device being configured to read information provided on a previously-assembled crimped assembly, the controller being further configured to determine identification information for the first component, the second component, and the die based on the information provided on the previously-assembled crimped assembly; and a display connected to the controller and configured to display to an operator the identification information for the first component, the second component, and the die.

15. A system for crimping a first component onto a second component, the system comprising:

a first plate;

a second plate facing the first plate;

at least one actuator configured to move the first plate relative to the second plate to compress a die disposed between the first plate and the second plate, the compression of the die causing the first and second components located in the die to be crimped together; and a controller connected to the at least one actuator and configured to:

directly determine an amount of deflection of the first plate while crimping, and determine a crimp dimension based on the determined amount of deflection.

16. The system of claim 15, wherein:

the die is tapered and is disposed in a conical-shaped die holder in the second plate; and the die includes a plurality of radial segments.

* * * * *